US011473377B2

(12) United States Patent
Dietrich et al.

(10) Patent No.: US 11,473,377 B2
(45) Date of Patent: Oct. 18, 2022

(54) ROTATING CONTROL DEVICE WITH FLEXIBLE SLEEVE

(71) Applicant: NTDrill Holdings, LLC, Houston, TX (US)

(72) Inventors: Earl Dietrich, Fulshear, TX (US); Christian Leuchtenberg, Shamrock Park (SG)

(73) Assignee: NTDrill Holdings, LLC, Houston, TX (US)

( * ) Notice: Subject to any disclaimer, the term of this patent is extended or adjusted under 35 U.S.C. 154(b) by 0 days.

(21) Appl. No.: 16/847,245

(22) Filed: Apr. 13, 2020

(65) Prior Publication Data

US 2020/0325737 A1 Oct. 15, 2020

Related U.S. Application Data

(60) Provisional application No. 62/832,996, filed on Apr. 12, 2019.

(51) Int. Cl.

| | |
|---|---|
| ***E21B 17/10*** | (2006.01) |
| ***E21B 33/12*** | (2006.01) |
| ***E21B 33/08*** | (2006.01) |

(52) U.S. Cl.

CPC ..... *E21B 17/1064* (2013.01); *E21B 33/085* (2013.01); *E21B 33/1208* (2013.01)

(58) Field of Classification Search

CPC . E21B 17/1064; E21B 33/085; E21B 33/1208
See application file for complete search history.

(56) References Cited

U.S. PATENT DOCUMENTS

| | | | | |
|---|---|---|---|---|
| 4,312,404 A * | 1/1982 | Morrow | E21B 33/085 166/88.4 |
| 4,363,357 A | 12/1982 | Hunter | |
| 4,423,776 A * | 1/1984 | Wagoner | E21B 33/085 166/84.3 |
| 6,354,385 B1 * | 3/2002 | Ford | E21B 3/04 166/84.3 |
| 8,109,337 B2 | 2/2012 | Parlee | |

(Continued)

FOREIGN PATENT DOCUMENTS

| | | |
|---|---|---|
| WO | 9827313 A1 | 6/1998 |
| WO | 2011128690 A1 | 10/2011 |

OTHER PUBLICATIONS

United Kingdom Search Report dated Jul. 20, 2020, for Application No. GB2005351.8, 1 page.

*Primary Examiner* — Aaron L Lembo
(74) *Attorney, Agent, or Firm* — Young Basile Hanlon & MacFarlane, P.C.

(57) ABSTRACT

A rotating control device (RCD) for use in pressurized drilling operations. The RCD having a non-rotating RCD housing enclosing an elongate passage, a tubular RCD mandrel extending along the elongate passage of the RCD housing, wherein the RCD mandrel has a longitudinal axis and is configured in use to rotate relative to the RCD housing about the longitudinal axis, and a stripper element which is mounted on an end of the RCD mandrel and which is configured to seal against and rotate with a tubular drill pipe extending along the elongate passage of the RCD housing, wherein the stripper element is secured to the end of the RCD mandrel by a flexible sleeve which is more flexible than the stripper element.

12 Claims, 6 Drawing Sheets

(56) References Cited

U.S. PATENT DOCUMENTS

| | | | | |
|---|---|---|---|---|
| 9,341,043 | B2 | 5/2016 | Bailey et al. | |
| 9,932,786 | B2 | 4/2018 | Chambers et al. | |
| 10,119,347 | B2 | 11/2018 | Johnson et al. | |
| 2009/0255734 | A1* | 10/2009 | Williams | E21B 33/085 264/255 |
| 2016/0334018 | A1* | 11/2016 | Travis | F16J 15/002 |
| 2018/0010415 | A1* | 1/2018 | Morton, III | E21B 33/126 |

* cited by examiner

ROTATING CONTROL DEVICE WITH FLEXIBLE SLEEVE

CROSS-REFERENCE TO RELATED APPLICATIONS

This is an non-provisional application based on U.S. Provisional Patent Application Ser. No. 62/832,996 filed on Apr. 12, 2019, which is incorporated in its entirety by reference.

FIELD OF INVENTION

The present disclosure relates in general to fluid drilling equipment and in particular, to a rotating control device (RCD) to be used for pressurized drilling operations. More specifically, embodiments of the present disclosure relate to a RCD having a flexible sleeve assembly between a bearing assembly and a stripper element for increasing bearing performance and life.

BACKGROUND OF INVENTION

In drilling a well, a drilling tool or "drill bit" is rotated under an axial load within a bore hole. The drill bit is attached to the bottom of a string of threadably connected tubulars or "drill pipe" located in the bore hole. The drill pipe is rotated at the surface of the well by an applied torque which is transferred by the drill pipe to the drill bit. As the bore hole is drilled, the hole bored by the drill bit is substantially greater than the diameter of the drill pipe. To assist in lubricating the drill bit, drilling fluid or gas is pumped down the drill pipe. The fluid jets out of the drill bit, flowing back up to the surface through the annulus between the wall of the bore hole and the drill pipe.

Conventional oilfield drilling typically uses hydrostatic pressure generated by the density of the drilling fluid or mud in the wellbore in addition to the pressure developed by pumping of the fluid to the bore hole. However, some fluid reservoirs are considered economically undrillable with these conventional techniques. New and improved techniques, such as underbalanced drilling and managed pressure drilling, have been used successfully throughout the world. Managed pressure drilling is an adaptive drilling process used to more precisely control the annular pressure profile throughout the wellbore. The annular pressure profile is controlled in such a way that the well is either balanced at all times, or nearly balanced with a low change in pressure. Underbalanced drilling is drilling with the hydrostatic head of the drilling fluid intentionally designed to be lower than the pressure of the formations being drilled. The hydrostatic head of the fluid may naturally be less than the formation pressure, or it can be induced.

Rotating control devices provide a means of sealing off the annulus around the drill pipe as the drill pipe rotates and translates axially down the well while including a side outlet through which the return drilling fluid is diverted. Such rotating control devices may also be referred to as rotating blowout preventers, rotating diverters or drilling heads. These units generally comprise a stationary housing or bowl including a side outlet for connection to a fluid return line and an inlet flange for locating the unit on a blowout preventer (BOP) or other drilling stack at the surface of the well bore. Within the bowl, opposite the inlet flange, a rotatable assembly, such as anti-friction bearings, is arranged which allows the drill pipe, located through the head, to rotate and slide. The assembly includes a seal onto the drill pipe which is typically made from rubber, polyurethane or another suitable elastomer.

For offshore applications on jack-up drilling rigs or floating drilling rigs, the rotating control device may be in the form of a cartridge assembly that is latched inside the drilling fluid return riser. In this case, the side outlet may be on a separate spool or outlet on the riser.

While the velocity of bearings in RCDs is not that high with maximum RPMs of 250 to 300 being at the high end, the bearing can be subjected to significant side loading caused by misalignment of the drilling rig and the RCD in the longitudinal axis. This may be due to an offset, tilt of the drilling rig due to settling or misalignment of the wellhead due to faulty installation of the upper casing bowl to the wellhead. This misalignment which can be significant often leads to rapid failure of the RCD bearings and is a known problem which is best prevented by properly aligning the derrick, rotary table and the top of the annular BOP to which the RCD housing is bolted. This means concentric axial alignment with no tilt. Even with all of these pro-active measures, settlement of the drilling rig, especially after heavy rains, can cause misalignment to occur, and thus, perfect alignment can be very difficult to regain in such cases.

External alignment solutions have been proposed in previous designs by having adjustable flange adapters between the casing bowl and the BOPs (blowout preventers) or by having external adjusters to change the angle of the BOP stack. These are good solutions if the problem is predetermined but difficult to implement after the fact.

Some RCD based solutions disclose a misalignment limiter and a ball joint, respectively. However, both of these solutions do not solve the side loading or intermittent wobble loading satisfactorily, as they do not provide for the required degrees of freedom to reduce the loads on the bearings.

A retrofittable solution consisting of various embodiments of a flexible sleeve is described that can fit between the main RCD mandrel and the stripper rubber sealing against the drill pipe. The sleeve is designed to enable the required degrees of freedom so that when the drill pipe pushes on the stripper rubber, which by design is very stiff, some of the side motion is absorbed thus transferring less intermittent high load variations to the bearings leading to longer bearing life.

SUMMARY OF INVENTION

The present disclosure provides a rotating control device for use in pressurized drilling operations, comprising a non-rotating RCD housing enclosing an elongate passage, a tubular RCD mandrel which extends along the elongate passage of the RCD housing, the RCD mandrel having an axis and being configured in use to rotate relative to the RCD housing about the axis, and a stripper element which is mounted on an end of the RCD mandrel and which is configured to seal against and rotate with a tubular drill pipe extending along the elongate passage of the RCD housing, wherein the stripper element is secured to the end of the RCD mandrel by means of a flexible sleeve which is more flexible than the stripper element.

The stripper element of the rotating control device may be an elastomer.

The flexible sleeve of the rotating control device may extend around and engage with a radially outwardly facing surface of the RCD mandrel.

The flexible sleeve of the rotating control device may be integral with the stripper element.

The flexible sleeve of the rotating control device may be separate from the stripper element.

The flexible sleeve of the rotating control device can be deformed to allow a range of translational movement of the stripper element relative to the RCD mandrel generally parallel to the axis of the RCD mandrel.

The flexible sleeve of the rotating control device can be deformed to allow a range of translational movement of the stripper element relative to the RCD mandrel generally perpendicular to the axis of the RCD mandrel.

The flexible sleeve of the rotating control device can be deformed to allow a range of rotational movement of the stripper element relative to the RCD mandrel about the axis of the RCD mandrel.

The flexible sleeve of the rotating control device can be deformed to allow a range of rotational movement of the stripper element relative to the RCD mandrel about an axis of rotation which is generally perpendicular to the axis of the RCD mandrel.

The rotating control device may further comprise a bearing assembly which supports the RCD mandrel in the RCD housing whilst allowing rotation of the RCD mandrel in the RCD housing.

The rotating control device may further comprise the flexible sleeve having an upper adapter connected to the RCE mandrel, and a lower adapter connected to the striper element, wherein an elastomeric portion is formed between the upper adapter and the lower adapter for providing flexibility to the flexible sleeve.

The rotating control device may further comprise the flexible sleeve having a reinforcing sleeve molded in the elastomeric portion to further enhance tensile resistance of the flexible sleeve.

The rotating control device may further comprise the flexible sleeve having at least one rigid ring molded in the elastomeric portion to resist the collapsing of the flexible sleeve.

The rotating control device may further comprise the flexible sleeve having at least one bellows molded in the elastomeric portion to provide torsional and pressure resistance to the flexible sleeve.

The rotating control device may further comprise the flexible sleeve having a plurality of washers adjacently stacked and molded into the elastomeric portion wherein each of the plurality of washers have correspondingly aligned holes that extend therethrough and are aligned with an aperture extending through the upper and lower adapters. Wire ropes extend through the holes in the plurality of washers and the apertures in the upper and lower adapters, and a ferrule is coupled to each end of the wire rope to adjustably tension the flexible sleeve.

The rotating control device may further comprise the flexible sleeve having an upper adapter connected to the RCE mandrel, and a lower adapter connected to the stripper element, wherein a plurality of relief cuts are formed on an outside circumference and a bore of the flexible sleeve to assist in the flexibility of the flexible sleeve.

The rotating control device may comprise the integral flexible sleeve and stripper element having an elastomer with at least one rigid ring molded in the elastomer to resist collapsing of the flexible ring.

BRIEF DESCRIPTION OF DRAWINGS

For a more complete understanding of the present disclosure and the advantages thereof, reference is now made to the following descriptions taken in conjunction with the accompanying drawings, in which.

DETAILED DESCRIPTION

The present disclosure is best understood from the following detailed description when read in conjunction with FIGS. 1-8 of the accompanying drawings, in which like numbers designate like parts.

Figure 1:
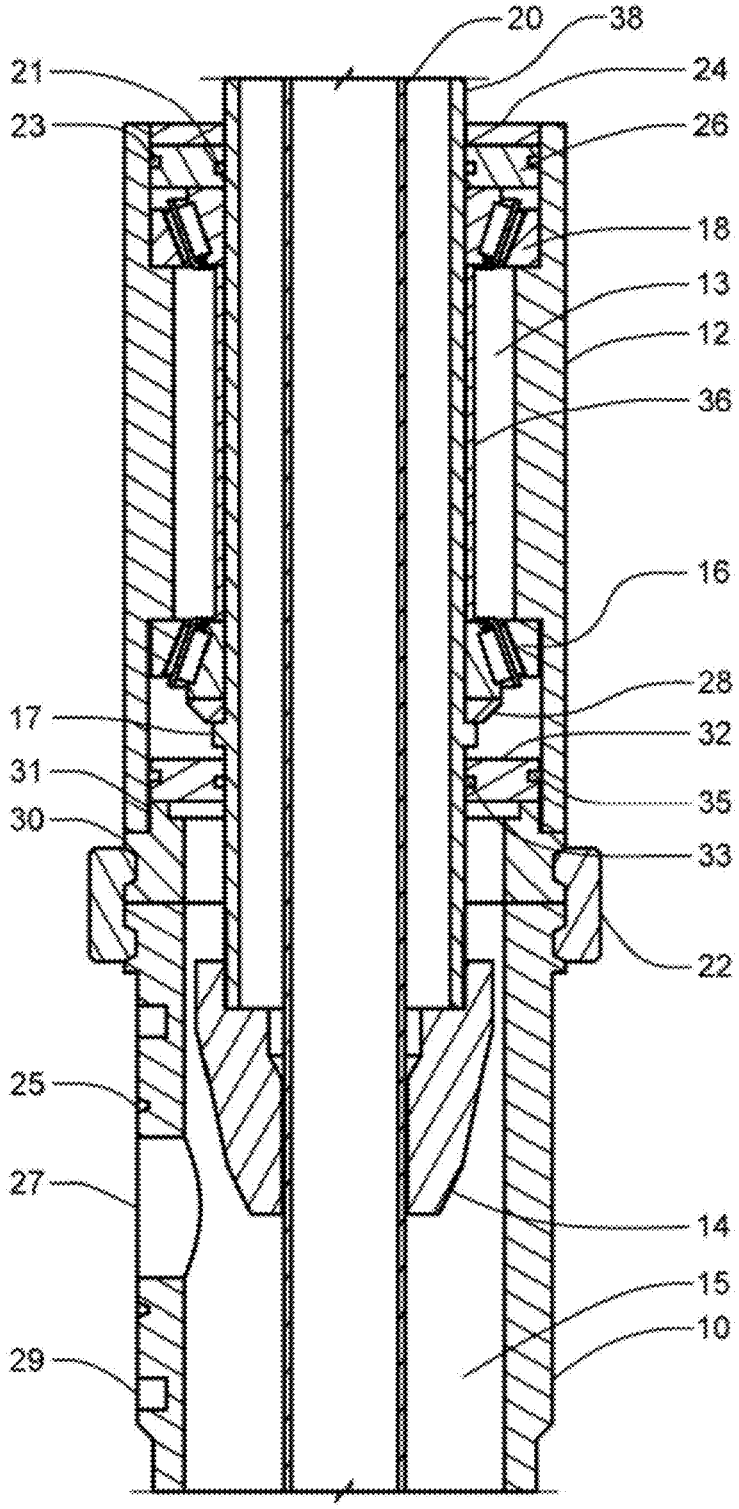
FIG. 1 (PRIOR ART)
FIG. 1 is a cross-sectional view of a prior art rotating control device.

As shown in FIG. 1, a typical prior art rotating control device (RCD) is provided to illustrate the common current methods of achieving sealing. The RCD has an upper housing 12 and a lower housing 10. The upper housing 12 has an adapter 30 with threads 31 to enable a clamp 22 to threadably connect the upper housing 12 to the lower housing 10. This is a common arrangement for land RCDs. The assembly may be in one piece and latched into a drilling riser (not shown) below the slip joint (not shown) for a floating drilling rig (not shown) or latched into a diverter (not shown) just above the blowout preventer (BOP) (not shown) on a jack-up drilling rig (not shown). A drill pipe 20 extends through the RCD assembly and is sealed with a stripper element or stripper rubber 14 attached to a RCD mandrel 38. There is a side outlet 27 with a seal groove 25 and stud holes 29 for bolting on a side outlet adapter (not shown). The pressure load from the stripper element 14, due to pressure in a cavity 15 when drilling with pressure, is transmitted via a load shoulder 17 on the RCD mandrel 38 via a spacer ring 28. The load is distributed between two sets of conical roller bearings, a lower conical roller bearing 16 and an upper conical roller bearing 18, with a spacer sleeve 36. The RCD mandrel 38 is free to rotate, as the drill pipe 20 rotates and frictionally transmits the torque through the stripper element 14 and transmits this rotation to the RCD mandrel 38. The upper part of the upper housing 12 has a retention plate 24 with a seal carrier 26 below the retention plate 24 which is sealed with a static seal 23 to the upper housing 12. A dynamic seal 21 seals a bearing cavity 13 from the outside environment. The dynamic seal 21 may be a sealing system consisting of multiple seals such as an excluder seal and a dynamic seal. A similar seal carrier 32 seals the bearing cavity 13 against the wellbore pressure in the cavity 15. Similar to the upper seal carrier 26, the seal carrier 32 may have a static seal 35 and a dynamic seal assembly 33 which can have one or more seals. The exact solution depends on the design of the RCD, and whether there is a pressurized oil supply to the bearing cavity 13, as this is a common method for cooling and lubricating the bearings. In order to resist significant pressure forces from the wellbore cavity 15 as well as mechanical wear from the drill pipe 20 being pushed in and out of the wellbore, the stripper element 14 is fabricated from an elastomeric material like polyurethane, rubber or similar materials, with a large wear allowance. This makes the stripper element 14 stiff, and any misalignment of the drill pipe 20 or the lower housing 10 will cause significant force oscillations to be transmitted laterally to the rotating RCD mandrel 38 which are detrimental to bearing life. In fact, it is known in the industry that an offset of one inch in the horizontal can lead to a significant reduction in bearing life. This is why the alignment of the RCD with the drill pipe 20, derrick and top of the annular BOP is an important consideration when verifying the installation.

Figure 2:
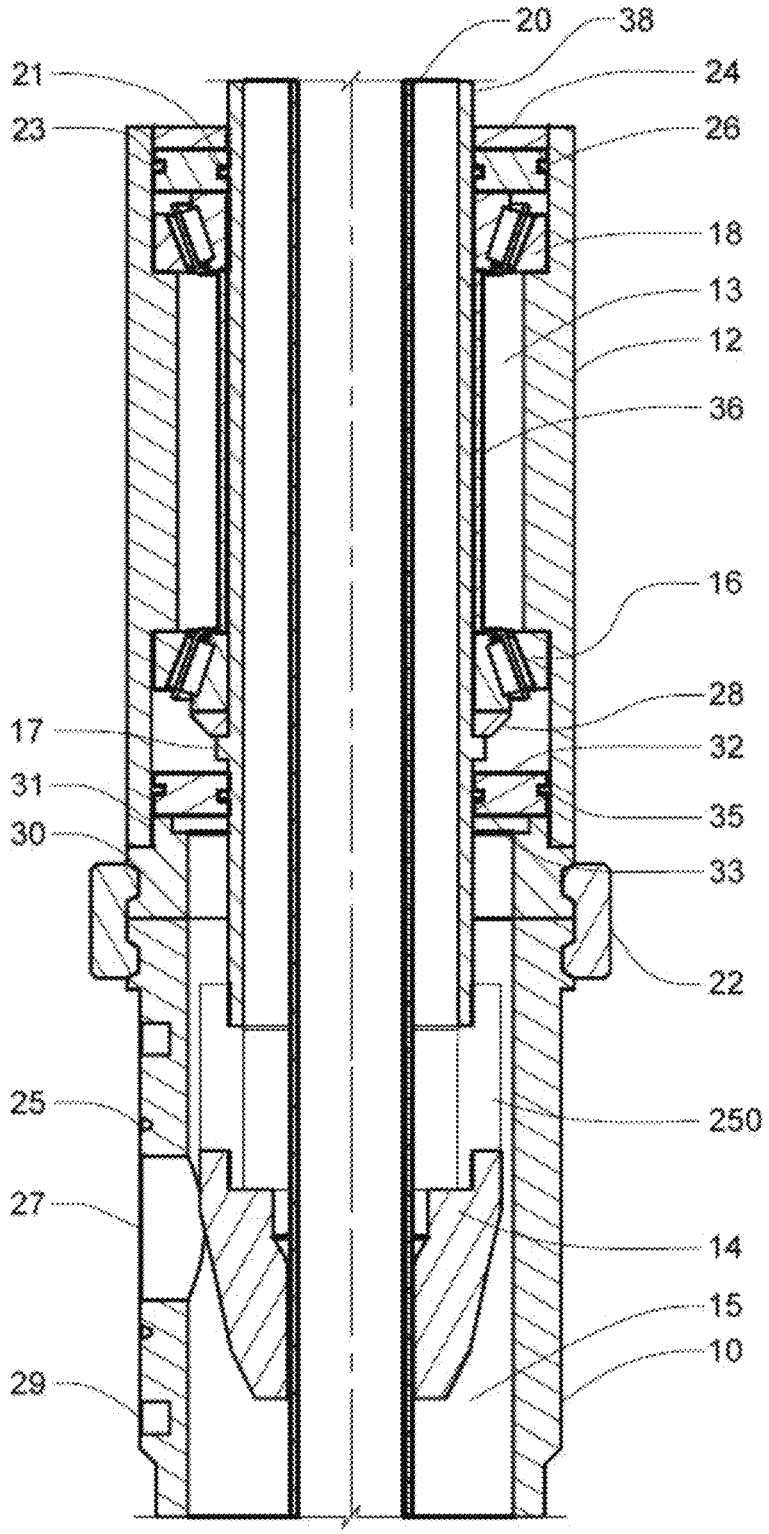
FIG. 2 is cross-sectional view of a rotating control device of the present disclosure showing the location of the flexible sleeve.

As seen in FIG. 2, the present disclosure provides a flexible sleeve 250 added to any existing RCD assembly between the stripper element 14 and the rotating RCD mandrel 38 to absorb forces caused by misalignment of the RCD with the rotary table or derrick. The flexible sleeve 250 can be independently formed or integrally molded with the stripper element 14.

Figure 3A:
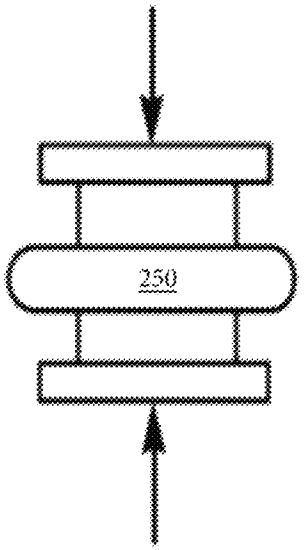
FIGS. 3*a*-3*e* are schematic drawings showing the degrees or restrictions of motion of the flexible sleeve of the present disclosure.
Figure 3B:
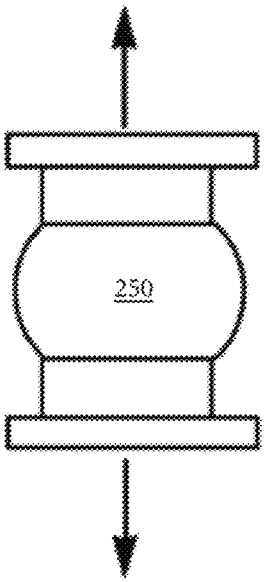
Figure 3C:
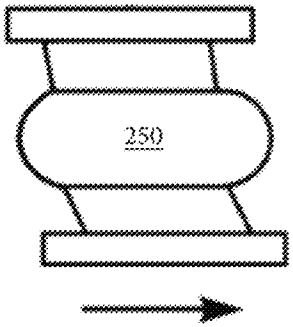
Figure 3D:
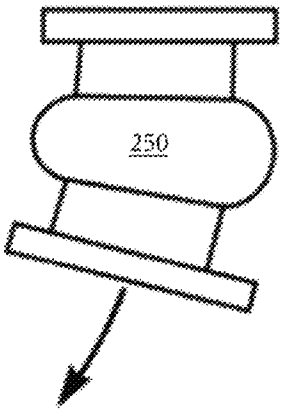
Figure 3E:
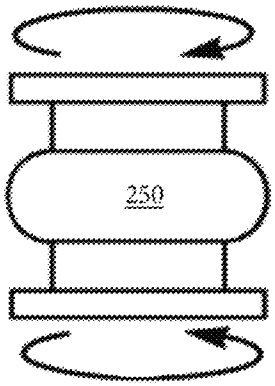

Referring now to FIGS. 3*a*-3*e*, the present disclosure shows the degrees of freedom or restriction of the flexible sleeve 250. The flexible sleeve 250 needs to be able to handle significant compression in the axial direction, as shown in FIG. 3*a*, under wellbore pressure in the cavity 15 without collapsing. In axial tension, as shown in FIG. 3*b*, the flexible sleeve 250 has to resist the force of a drill pipe tool joint (not shown) being pushed through the stripper element 14 which can be up to 30,000 pounds on a new stripper element 14. The flexible sleeve 250 also needs to accommodate transverse displacement, as shown in FIG. 3*c*, that can be caused by the drill pipe 20 being off center or tilted, as shown in FIG. 3*d*. Lastly, the flexible sleeve 250 needs to provide torsional resistance in the clockwise direction when looking into the wellbore that is equivalent to the bearing torque of the RCD bearings when under load. Counterclockwise torsional resistance, as shown in FIG. 3*e*, is rare, as such counterclockwise torsional resistance only occurs when rotating the drill string (drill pipe) counterclockwise for special downhole tools (not shown), wherein the counterclockwise torsional resistance would be of the same order of magnitude as the torque of the drill pipe 20. The flexible sleeve 250 can handle the motions described by FIGS. 3*c*, 3*d* and 3*e* when under varying tension, as shown in FIG. 3*b*, or compressive loads, as shown in FIG. 3*a*.

FIGS. 4-7 provide various embodiments of the flexible sleeve 250, wherein all of the embodiments have the same internal, left handed threads on upper adapters 300, 350, 400, and 550 which are used to connect the upper adapters 300, 350, 400, and 550 to the rotating RCD mandrel 38. In a non-limiting disclosure, these upper adapters 300, 350, 400, and 550 may be fabricated from steel or other high strength materials. The connection between the upper adapters 300, 350, 400, and 550 of the flexible seal 250 and the RCE mandrel 38 may be different than a threaded connection. For example, the connection may comprise a bolt or socket type connection with retainer screws or any other suitable method for affixing the flexible sleeve 250 to the RCD mandrel 38. Left-handed threads may be used to prevent the un-torqueing and disconnecting of the flexible sleeve 250 while drilling, wherein the drilling is carried out by default in a clockwise direction looking downhole. Similarly, as shown in all of the embodiments of FIGS. 4-7, lower adapters 340, 380, 500 and 580 have an external left-handed thread for threading the lower adapters 340, 380, 500 and 580 of the flexible sleeve 250 into the upper part of the stripper element 14, wherein such stripper elements 14 typically have a steel or other high strength material integrally molded within the elastomer material of the stripper element 14. The connection between the lower adapters 340, 380, 500 and 580 of the flexible sleeves 250 and the stripper element 14 may be different than a threaded connection. For example, the connection may be a bolt or socket type connection with retainer screws or any other suitable method for affixing the flexible sleeve 250 to the stripper element 14.

Figure 4:
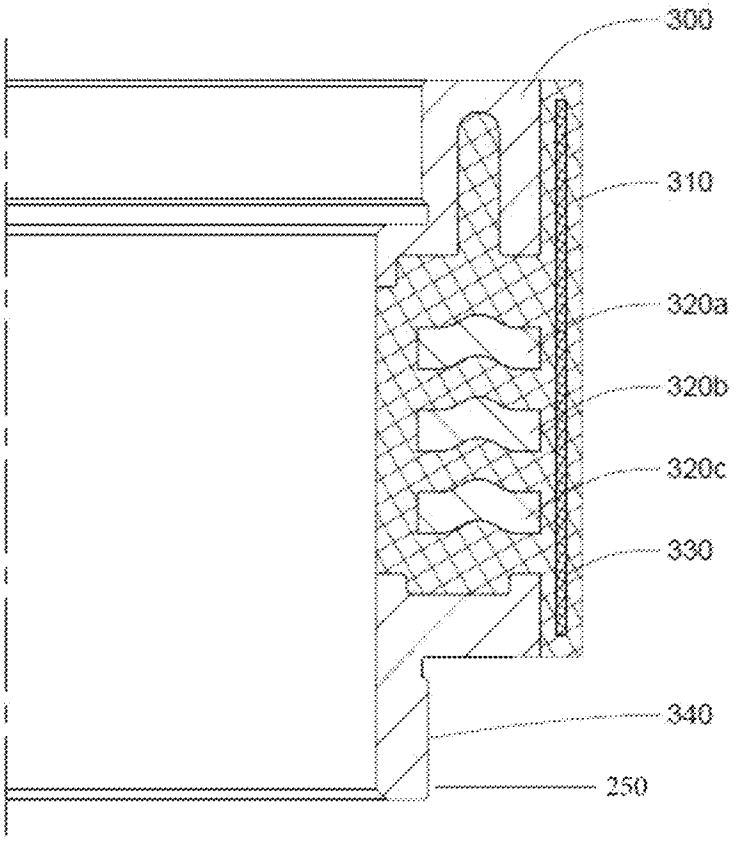
FIG. 4 is a cross-sectional view of a proposed embodiment of the flexible sleeve of the present disclosure.

As shown in FIG. 4, the upper adapter 300 of the flexible sleeve 250 is connected to the RCD mandrel 38, and the lower adapter 340 of the flexible sleeve 250 is connected to the stripper element 14. The two adapters 300, 340 are joined by an elastomer 310 that allows the assembly to flex. In a non-limiting disclosure, the elastomer 310 may be fabricated from a polyurethane, natural rubber, synthetic rubber or any other suitable elastomer. To maintain greater flexibility, the elastomer 310 may have a thinner wall thickness or a lower Shore Durometer (system for assessing hardness of elastomers and hence flexibility for a particular compound) or a combination of both. This will give the required degrees of freedom to the flexible sleeve 250 in the embodiments shown in FIGS. 3*c* and 3*d*. In order to provide better collapse resistance (FIG. 3*a*) to the flexible sleeve 250, three substantially rigid, hard rings 320*a*, 320*b*, and 320*c* are molded integrally within the elastomer 310 of the flexible sleeve 250. The three rings 320*a*, 320*b*, 320*c* have a wave formed in the rings 320*a*, 320*b*, 320*c* to assist in resisting the collapse of the flexible sleeve 250. Two or more of the rings 320*a*, 320*b*, 320*c* may be made of particular or differing materials. The rings 320*a*, 320*b*, 320*c* also serve to reinforce the softer/thinner elastomer 310 from internal or external pressure. In order to improve the tensile resistance (FIG. 3*b*) of the flexible sleeve 250, a reinforcing sleeve 330 may be molded into the elastomer 310. In a non-limiting disclosure, the reinforcing sleeve 330 can be fabricated from Kevlar (tradename of a high tensile Dupont fiber), carbon fiber, high tensile steel mesh or other suitable flexible material. No additional reinforcement is foreseen for the torsional resistance requirement disclosed in FIG. 3*e*, as the applied forces are not significant, and the cross section of the elastomer 310 would be designed to be sufficient for this purpose.

Figure 5:
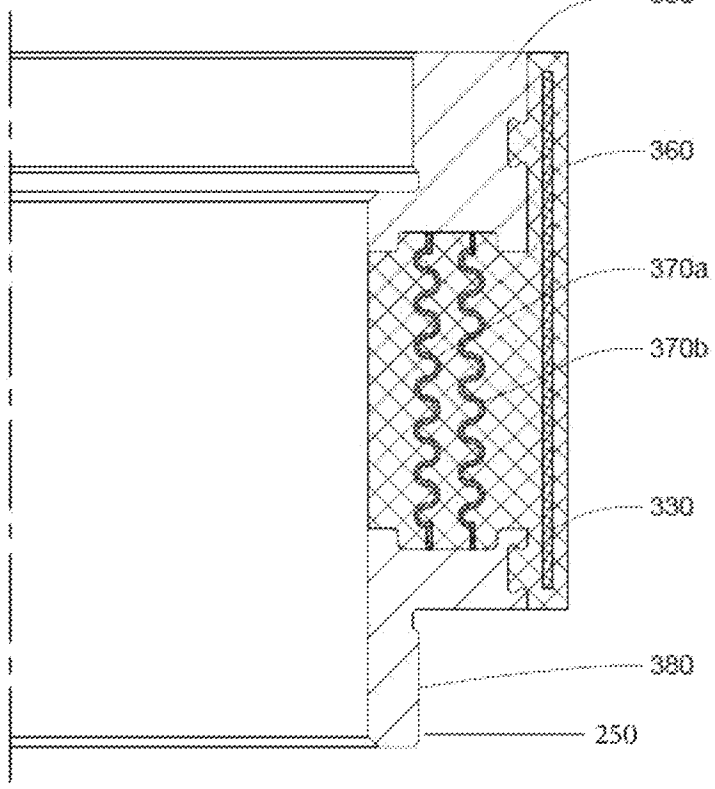
FIG. 5 is a cross-sectional view of another proposed embodiment of the flexible sleeve of the present disclosure.

FIG. 5 shows another proposed embodiment, wherein the upper and lower adapters 350, 380 of the flexible sleeve 250 are joined by an elastomer 360 that allows the assembly to flex. The same possibilities and properties as expressed for the elastomer 310 in FIG. 4 are assumed. The flexible sleeve 250 also has a reinforcing sleeve 330 with similar design possibilities as disclosed in FIG. 4. The additional requirements for FIGS. 3*a*, 3*b* and 3*e* are fulfilled by having two bellows 370*a*, 370*b* that are rigidly affixed to the upper and lower adapters 350, 380. The bellows 370*a*, 370*b*, typically thin walled for flexibility, provide additional pressure resistance to the flexible sleeve 250, both internal and external, as well as a significant torsional resistance, while still allowing the movements disclosed in FIGS. 3*c* and 3*d*. One or more of the bellows 370*a*, 370*b* may be made of suitable materials and of different materials. The bellows 370*a*, 370*b* can also be perforated or otherwise enhanced or modified.

Figure 6:
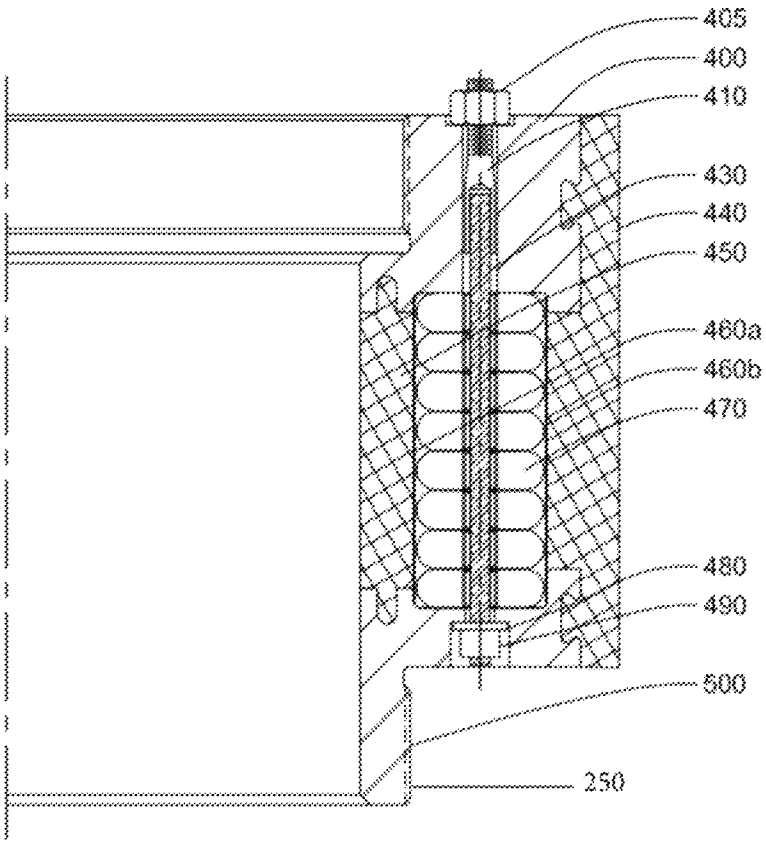
FIG. 6 is a cross-sectional view of yet another proposed embodiment of the flexible sleeve of the present disclosure.

FIG. 6 shows yet another proposed embodiment of the present disclosure, wherein the upper adapter 400 and the lower adapter 500 of the flexible sleeve 250 are separated by a stack of eight similar rigid washers 470. The washers 470 are lubricated. To hold the upper and lower adapters 400, 500 together, twelve wire ropes 430 are inserted into aligned holes extending through the washers 470. The bottom of the wire ropes 430 is held in place by a ferrule or a captive nut 490 with a washer 480 or other type of wire termination system. The top end of the wire ropes 430 is terminated in a ferrule 410 with an extended thread onto which a nut 405 is threaded thereon allowing the system to be adjustably tensioned. The holes through the washers 470 accommodating the wire ropes 430 are oversized with respect to the wire ropes 430 to enable freedom of movement. Such a system allows for easy free movement of the type shown in FIG. 3*c*. The required degree of movement disclosed in FIG. 3*d* can be achieved by the tension/flexibility of the wire ropes 430 or another suitable joiner which is adjustable. Some of the rigid washers 470 can be substituted for elastomeric washers to further enhance this movement pattern of FIG. 3*d* as required. The required pressure barrier is then fulfilled by integrally molding an inner elastomer sleeve 450 and an outer elastomeric sleeve 440 in the flexible sleeve 250. In order not to have the elastomer sleeves 450, 440 rigidly affixed to the washers 470, the inside of the washers 470 may have a flexible, impermeable tube or sleeve 460*a* that prevents the elastomer sleeves 450, 440 from adhering to the washers 470. A similar sleeve 460*b* can be used on the outer diameter of the washers 470. The washers 470 are shown with rounded edges to prevent damage to the elastomer sections 450 and 440 when in use. The washers 470 are also shown as substantially parallel, but the washers 470 could also be beveled or dished shaped on one or both sides to enhance the movement requirements. In torsion as shown by FIG. 3*e*, the wire ropes 430 can twist inside the oversize holes in the washers 470 wherein the additional tension provides the necessary torsional resistance of the design.

Figure 7:
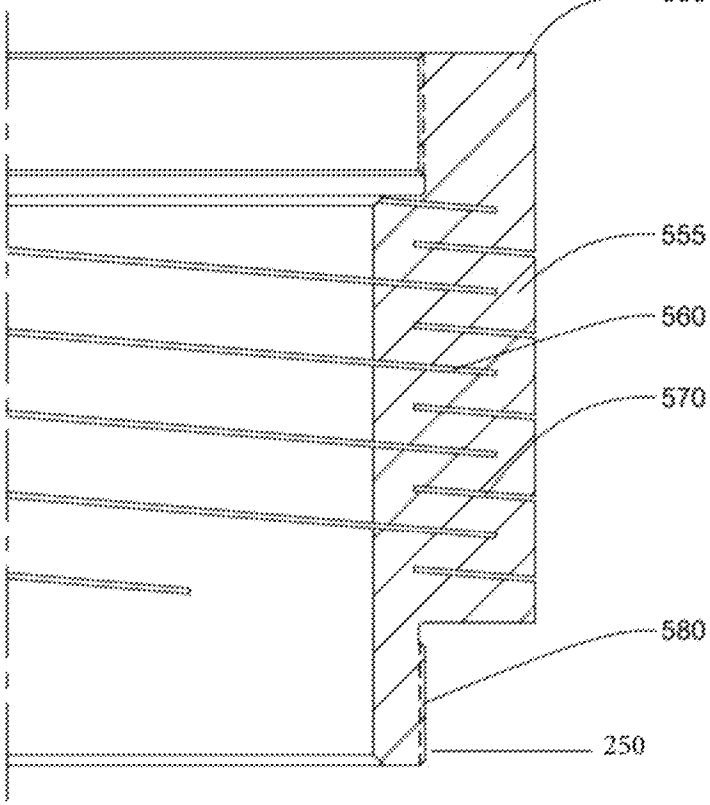
FIG. 7 is a cross-sectional view of even yet another proposed embodiment of the flexible sleeve of the present disclosure.

In even yet another embodiment shown in FIG. 7, the flexible sleeve 250 is completely fabricated from a rigid material like steel, aluminum, a composite material consisting of fibers (Carbon, glass, Kevlar) and cured resin, or other suitable material combination. The upper and lower adapters 550, 580 of the flexible sleeve 250 can be separate from the main body 555 or integrally formed therewith, i.e. machined out of a single piece of material. The required flexibility of the flexible sleeve is created by having a pattern of recessed cuts 570 formed on the outside circumference of the flexible sleeve 250 from the outside diameter inwards and another pattern of recessed cuts 560 extending inwards from the bore of the flexible sleeve 250. These cuts 570, 560 can be individual horizontal cuts, or helical continuous cuts, as shown in FIG. 7. The cuts 570, 560 may have rounded tips on the inside of the cuts 570, 560 to prevent cracking and stress concentrations. The cuts 570, 560 can be wider and filled with an elastomeric material. A continuous wall of solid material, even though not in the same plane, provides for pressure isolation. Such a design can be evaluated with Finite Element Analysis (FEA) to give the requisite properties required by FIGS. 3*a*-3*e*. Such complex shapes may be machined with Electrostatic Discharge Machining or printed with three dimensional printers using metals or other suitable materials.

Figure 8:
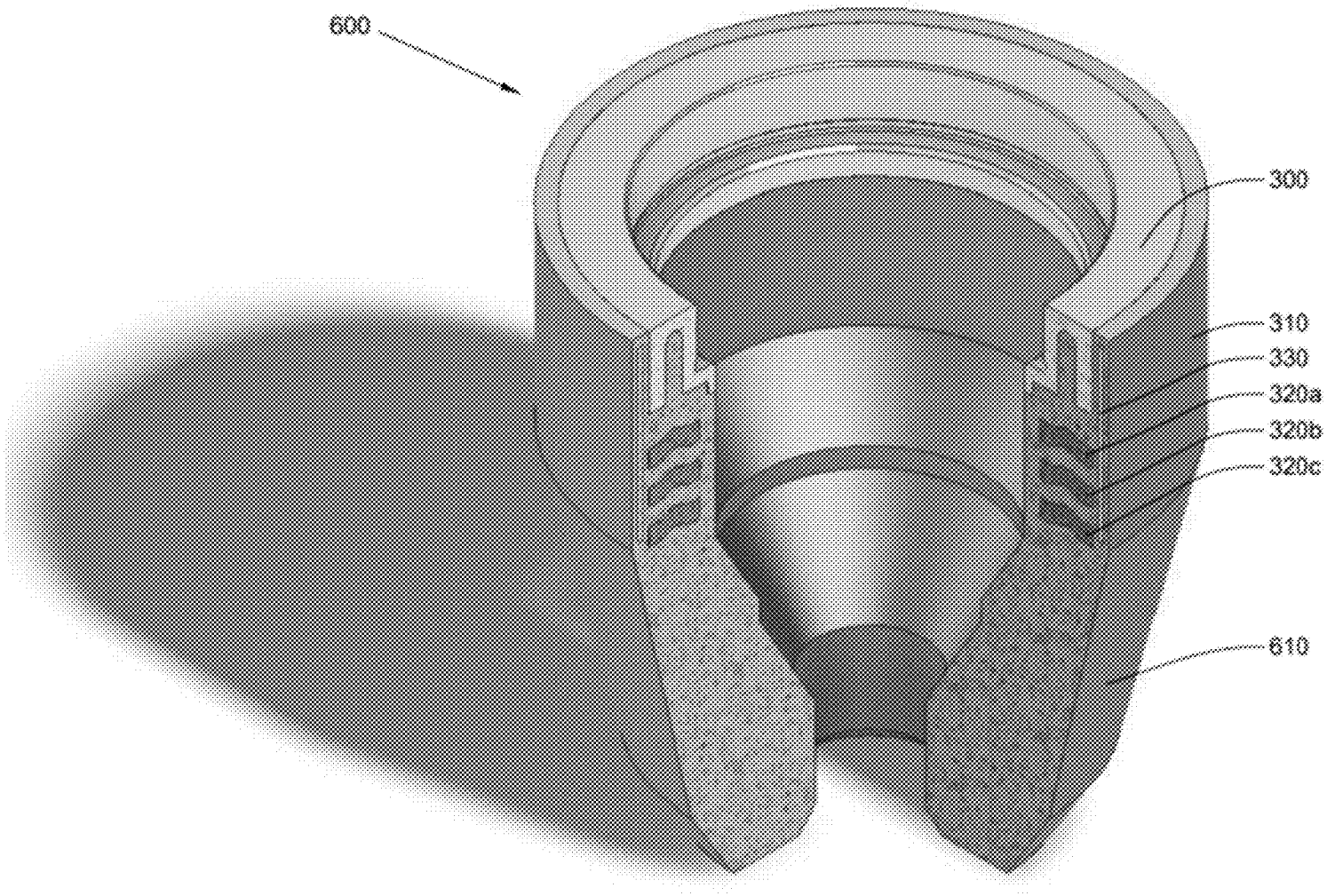
FIG. 8 is an isometric sectional view of an integral embodiment of the flexible sleeve and the stripper element of the present disclosure.

As shown in FIG. 8, the present disclosure of the flexible sleeve 250 does not have to be a separate structure, but rather, the present disclosure may provide an integral assembly 600 which consists of the upper part 300 of the assembly in FIG. 4, with like parts named the same, and a lower part 610 of the stripper element 14 integrally formed thereon. This means that the elastomer of the flexible part 310 is the same elastomer as the lower part 610. Such a design is advantageous in that the design occupies less overall vertical space. The design also ensures pro-active replacement of the flexible sleeve 250 to avoid fatigue failures, as the flexible part 310 is replaced with a completely new assembly when the end of the stripper element 14 has worn out.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

What is claimed is:

1. A rotating control device (RCD) for use in pressurized drilling operations, comprising:
   - a non-rotating RCD housing enclosing an elongate passage;
   - a tubular RCD mandrel which extends along the elongate passage of the RCD housing, the RCD mandrel having a longitudinal axis and being configured in use to rotate relative to the RCD housing about the longitudinal axis; and
   - a stripper element which is mounted on an end of the RCD mandrel and which is configured to seal against and rotate with a tubular drill pipe extending along the elongate passage of the RCD housing, wherein the stripper element is secured to the end of the RCD mandrel by a flexible sleeve which is separate from and more flexible than the stripper element and can be deformed to allow a range of transitional movement of the stripper element relative to the RCD mandrel generally perpendicular to the axis of the RCD mandrel.

2. The rotating control device according to claim 1, wherein the stripper element is elastomeric.

3. The rotating control device according to claim 1, wherein the flexible sleeve extends around and engages with a radially outwardly facing surface of the RCD mandrel.

4. The rotating control device according to claim 1, wherein the flexible sleeve can be deformed to allow a range of translational movement of the stripper element relative to the RCD mandrel generally parallel to the axis of the RCD mandrel.

5. The rotating control device according to claim 1, wherein the flexible sleeve can be deformed to allow a range of rotational movement of the stripper element relative to the RCD mandrel about the axis of the RCD mandrel.

6. The rotating control device according to claim 1, wherein the flexible sleeve can be deformed to allow a range of rotational movement of the stripper element relative to the RCD mandrel about an axis of rotation which is generally perpendicular to the axis of the RCD mandrel.

7. The rotating control device according to claim 1, further comprising a bearing assembly which supports the RCD mandrel in the RCD housing whilst allowing rotation of the RCD mandrel in the RCD housing.

8. A rotating control device (RCD) for use in pressurized drilling operations, comprising:

a non-rotating RCD housing enclosing an elongate passage;

a tubular RCD mandrel which extends along the elongate passage of the RCD housing, the RCD mandrel having a longitudinal axis and being configured in use to rotate relative to the RCD housing about the longitudinal axis; and a stripper element which is mounted on an end of the RCD mandrel and which is configured to seal against and rotate with a tubular drill pipe extending along the elongate passage of the RCD housing, wherein the stripper element is secured to the end of the RCD mandrel by a flexible sleeve which is more flexible than the stripper element, wherein the flexible sleeve further comprises:

an upper adapter connected to the RCD mandrel, and a lower adapter connected to the stripper element; and an elastomeric portion formed between the upper adapter and the lower adapter for providing flexibility to the flexible sleeve.

9. The rotating control device according to claim 8, wherein the flexible sleeve further comprises a reinforcing sleeve molded in the elastomeric portion to further enhance tensile resistance of the flexible sleeve.

10. The rotating control device according to claim 8, wherein the flexible sleeve further comprises at least one rigid ring molded in the elastomeric portion to resist the collapsing of the flexible sleeve.

11. A rotating control device (RCD) for use in pressurized drilling operations having a non-rotating RCD housing enclosing an elongate passage for housing a tubular RCD mandrel extending along the elongate passage of the RCD housing wherein a tubular drill pipe extends through the RCD mandrel, comprising:

the RCD mandrel having a longitudinal axis and being configured in use to rotate relative to the RCD housing about said the longitudinal axis; and a stripper element which is mounted on an end of the RCD mandrel and which is configured to seal against and rotate with the tubular drill pipe extending along the elongate passage of the RCD housing; and a flexible sleeve having an upper adapter connected to the RCD mandrel, and a lower adapter connected to the stripper element for securing the stripper element to the end of the RCD mandrel, wherein the flexible sleeve is more flexible than the stripper element.

12. The rotating control device according to claim 11, wherein an elastomeric portion is provided between the upper adapter and the lower adapter to provide flexibility to the flexible sleeve.

* * * * *